US012765683B1

(12) United States Patent
Johnson

(10) Patent No.: US 12,765,683 B1
(45) Date of Patent: Oct. 20, 2026

(54) LUGGAGE WITH FOLD OUT TABLE SURFACE

(71) Applicant: Jeffrey Johnson, Brighton, NY (US)

(72) Inventor: Jeffrey Johnson, Brighton, NY (US)

( * ) Notice: Subject to any disclaimer, the term of this patent is extended or adjusted under 35 U.S.C. 154(b) by 2 days.

(21) Appl. No.: 18/959,863

(22) Filed: Nov. 26, 2024

(51) Int. Cl.
*A47C 17/82* (2006.01)
*A45C 15/00* (2006.01)
*A45C 5/03* (2006.01)

(52) U.S. Cl.
CPC ..... *A47C 17/82* (2013.01); *A45C 15/00* (2013.01); *A45C 5/03* (2013.01)

(58) Field of Classification Search
CPC ..... A47C 17/82; A45C 15/00; A45C 5/03
USPC ..... 5/114
See application file for complete search history.

(56) References Cited

U.S. PATENT DOCUMENTS

| | | | | |
|---|---|---|---|---|
| 8,613,349 | B1 * | 12/2013 | Halko | A45C 9/00 280/37 |
| 9,474,346 | B2 | 10/2016 | Simon | |
| 9,498,055 | B2 | 11/2016 | Distefano | |
| D859,876 | S | 9/2019 | Melaragno | |
| 10,561,234 | B1 | 2/2020 | von Goins | |
| 11,140,958 | B1 | 10/2021 | Baldwin | |
| 11,497,316 | B1 * | 11/2022 | Habchi | A47C 17/70 |
| 11,612,448 | B2 * | 3/2023 | Gustafson | A45C 13/02 206/570 |
| 11,903,470 | B1 * | 2/2024 | Feng | A45C 13/262 |
| 2017/0325560 | A1 | 11/2017 | Williams | |
| 2017/0332754 | A1 * | 11/2017 | Holland | A45C 9/00 |
| 2018/0116361 | A1 | 5/2018 | Anjum | |

FOREIGN PATENT DOCUMENTS

WO 2018087636 5/2018

OTHER PUBLICATIONS

Genesis Luggage, "The LugCot", Mar. 11, 2022, Vimeo (https://vimeo.com/687296744?turnstile=0.znm3Ff4kB0u1b4HBHHcAQcTXXWV97_117klQusdomNoNdER6DCg8KSXQ8OFfHpawOju7PysEpVLZB4wbP_ABiYge70XWa2WpSw3IAlhCvRt646Z2IZ4mxfe2jq0WtsHV05m126UVsybB--4AxhmK92YpGd21SUod7quUZ807UvvtszWLqfUtmiDo9Ftjy_PNgp9BdC9QsWucdptRr-SK9bFMY5PcA90Qkw.*
Melissa Miller, "LugCot", Sep. 16, 2016, Youtube (https://www.youtube.com/watch?v=4kvTM3gcjKU).*

* cited by examiner

*Primary Examiner* — David R Hare
*Assistant Examiner* — Joseane E. Tejada
(74) *Attorney, Agent, or Firm* — Kyle A. Fletcher, Esq.

(57) ABSTRACT

The luggage with fold out table surface is a luggage item. The luggage with fold out table surface incorporates a frame structure, a platform structure, and a nightstand structure. The platform structure and the nightstand structure attach to the frame structure. The platform structure is a collapsible structure. The platform structure deploys to form an elevated and horizontally oriented platform that is used as a bed. The nightstand structure deploys to form an elevated horizontally oriented working surface.

12 Claims, 9 Drawing Sheets

LUGGAGE WITH FOLD OUT TABLE SURFACE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of luggage accessories. (A45C13/00)

SUMMARY OF INVENTION

The luggage with fold out platform surface is a luggage item. The luggage with fold out platform surface comprises a frame structure, a platform structure, and a nightstand structure. The platform structure and the nightstand structure attach to the frame structure. The platform structure is a collapsible structure. The platform structure deploys to form an elevated and horizontally oriented platform that is used as a bed. The nightstand structure deploys to form an elevated horizontally oriented working surface.

These together with additional objects, features and advantages of the luggage with fold out platform surface will be readily apparent to those of ordinary skill in the art upon reading the following detailed description of the presently preferred, but nonetheless illustrative, embodiments when taken in conjunction with the accompanying drawings.

In this respect, before explaining the current embodiments of the luggage with fold out platform surface in detail, it is to be understood that the luggage with fold out platform surface is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the luggage with fold out platform surface.

It is therefore important that the claims be regarded as including such equivalent construction insofar as they do not depart from the spirit and scope of the luggage with fold out platform surface. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
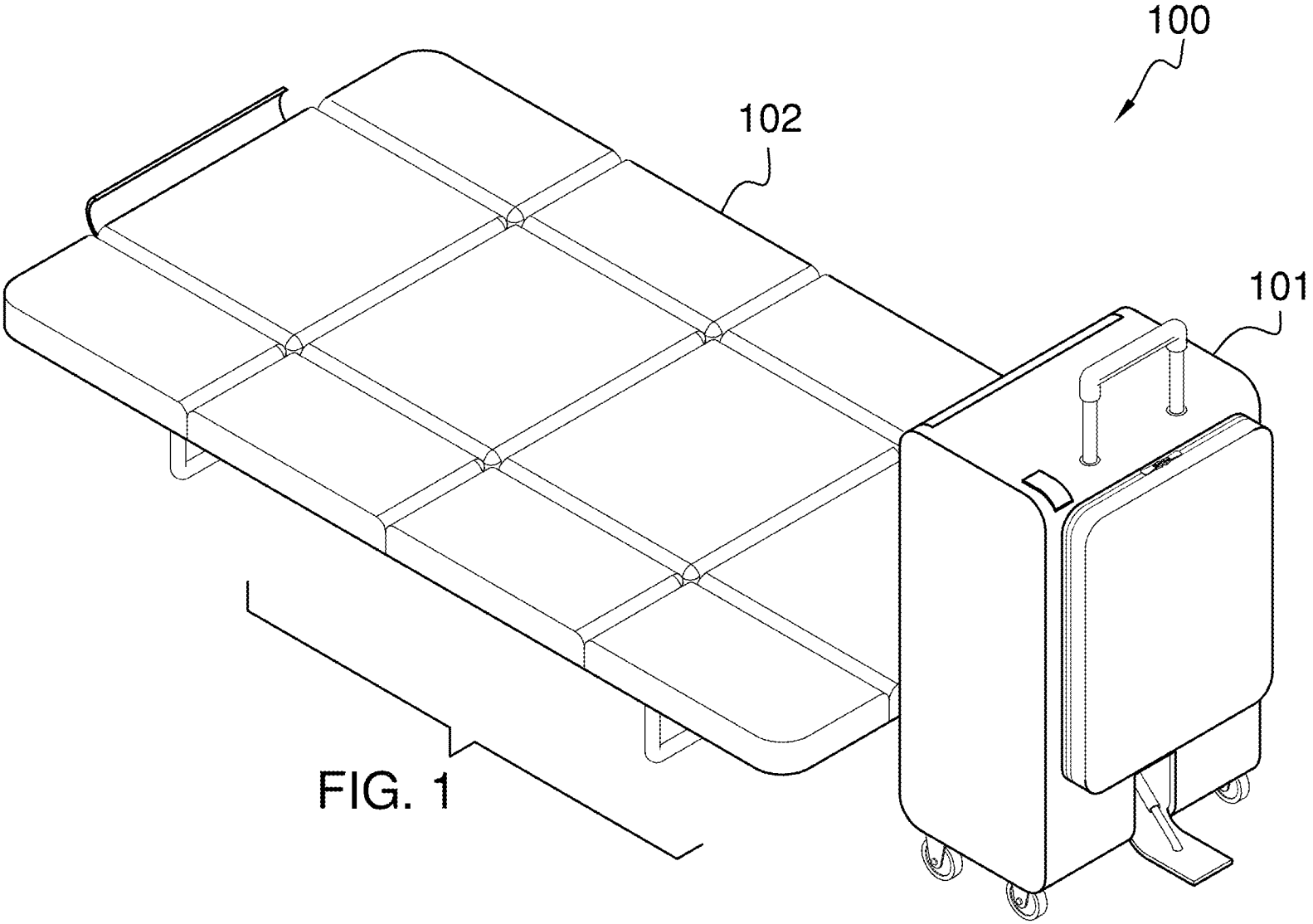
FIG. 1 is a perspective view of an embodiment of the disclosure.
Figure 2:
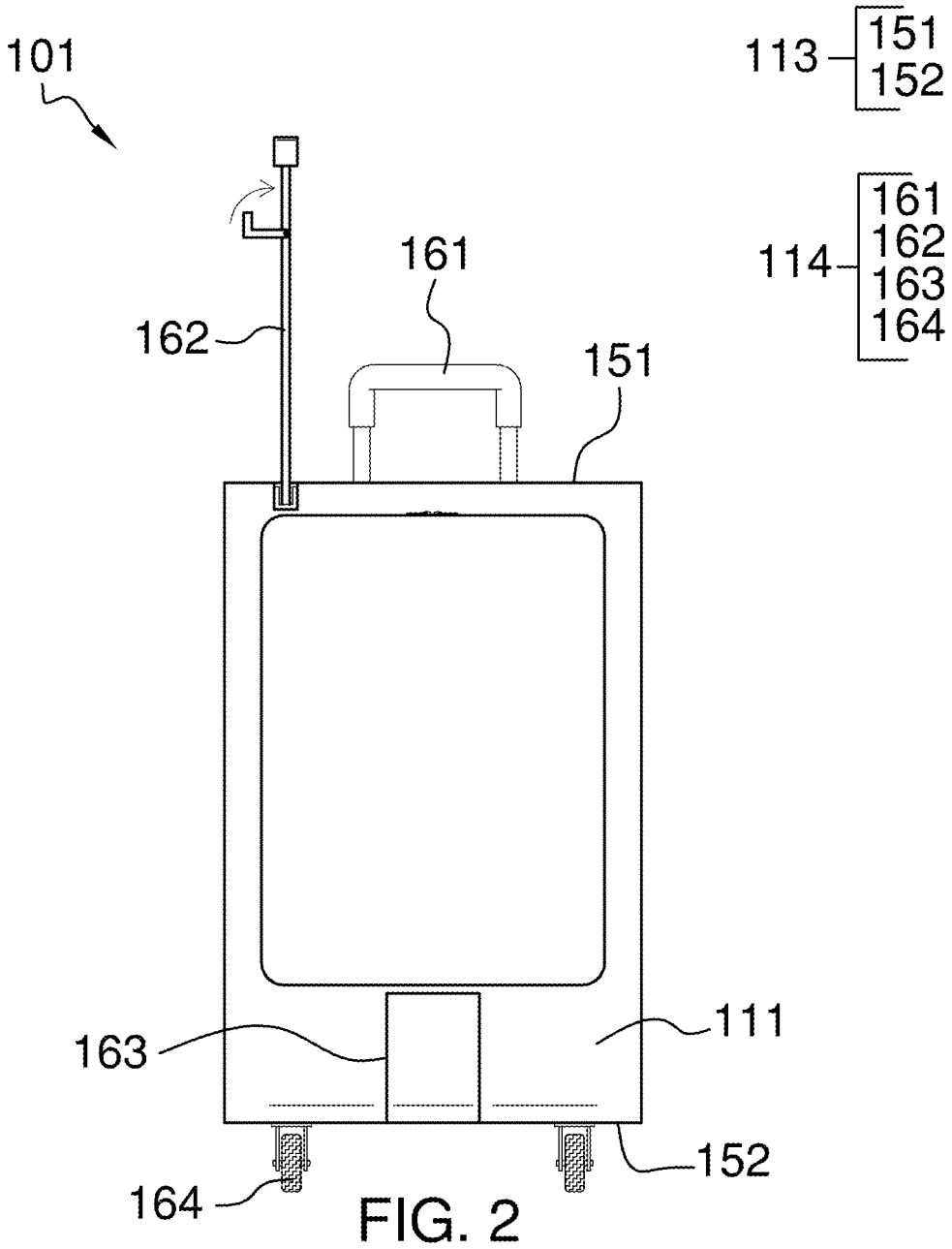
FIG. 2 is an anterior view of an embodiment of the disclosure.
Figure 3:
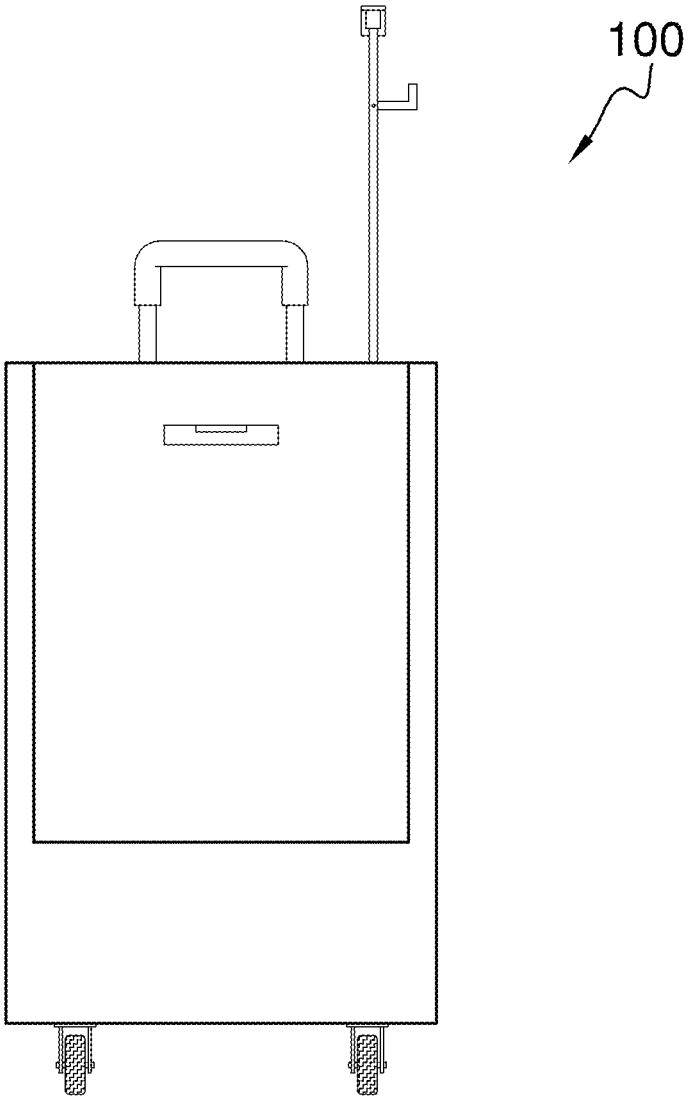
FIG. 3 is a posterior view of an embodiment of the disclosure.
Figure 4:
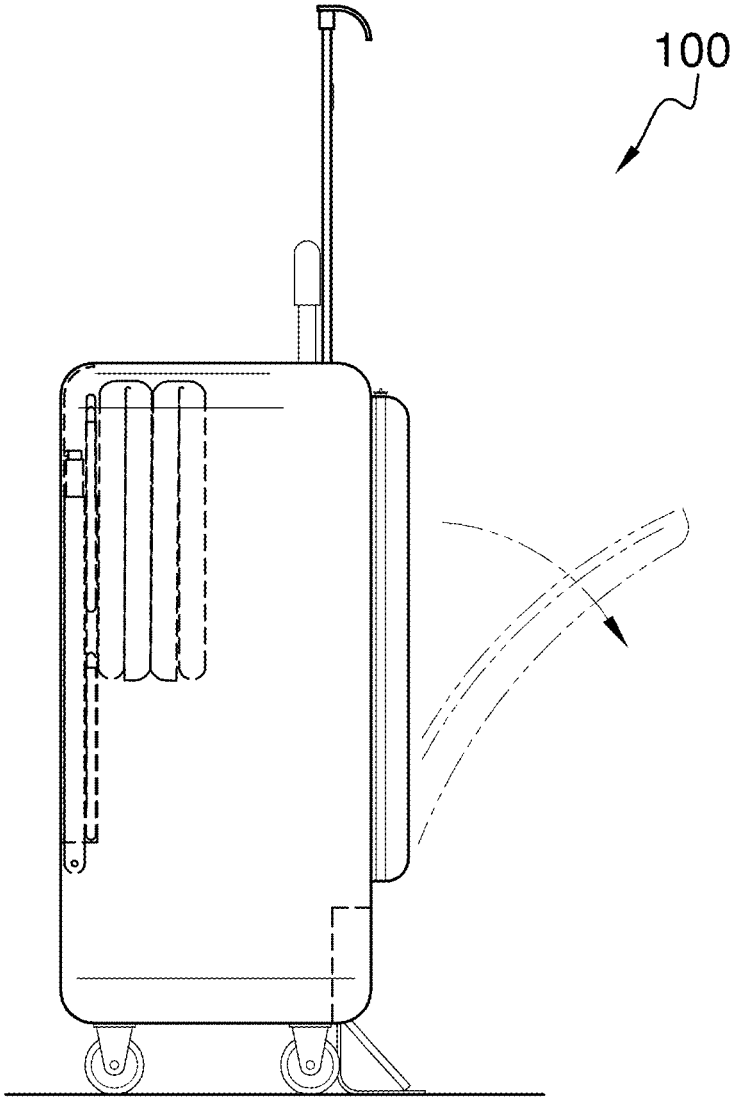
FIG. 4 is a side view of an embodiment of the disclosure.
Figure 5:
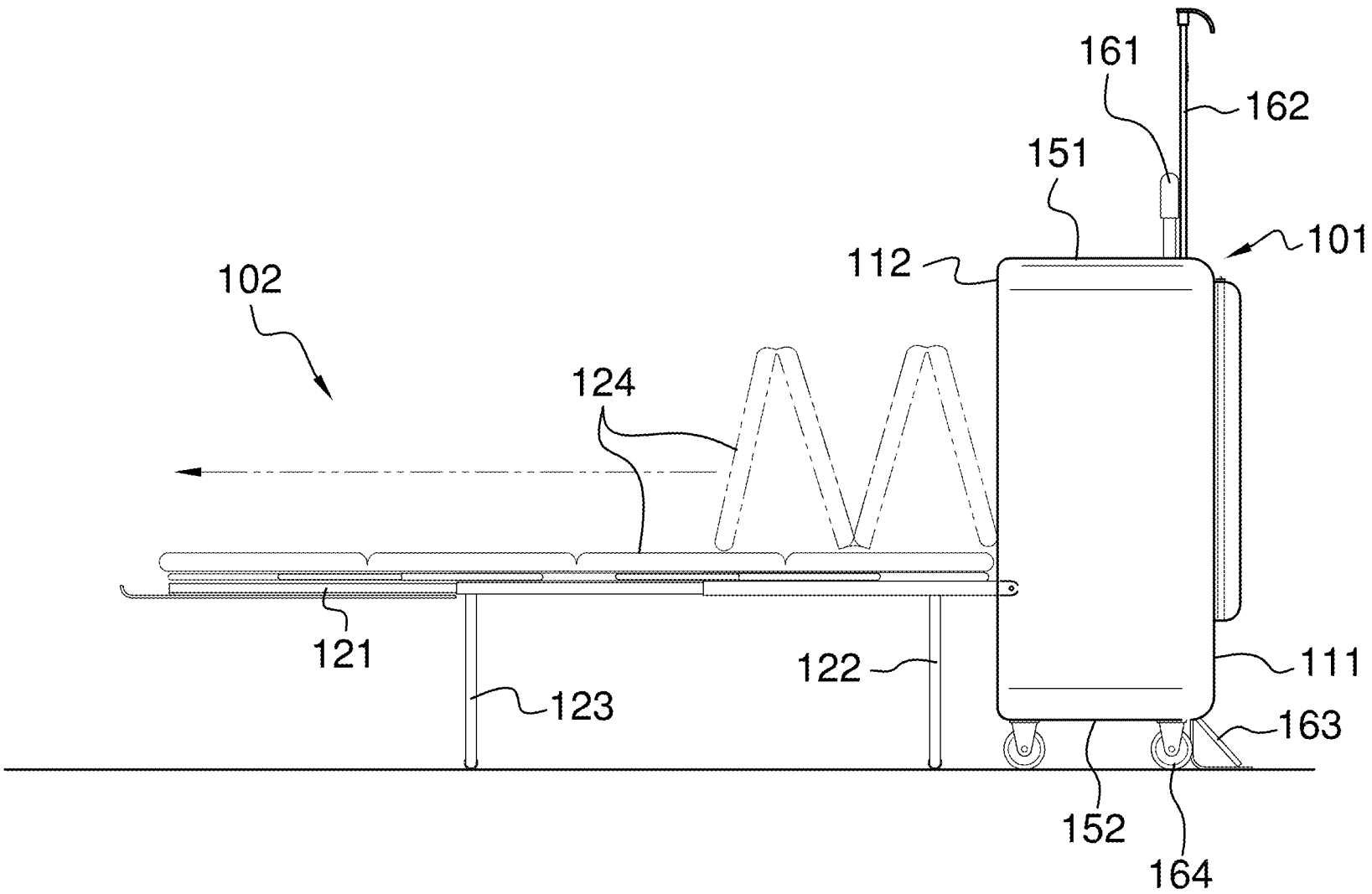
FIG. 5 is a side view of an embodiment of the disclosure.
Figure 6:
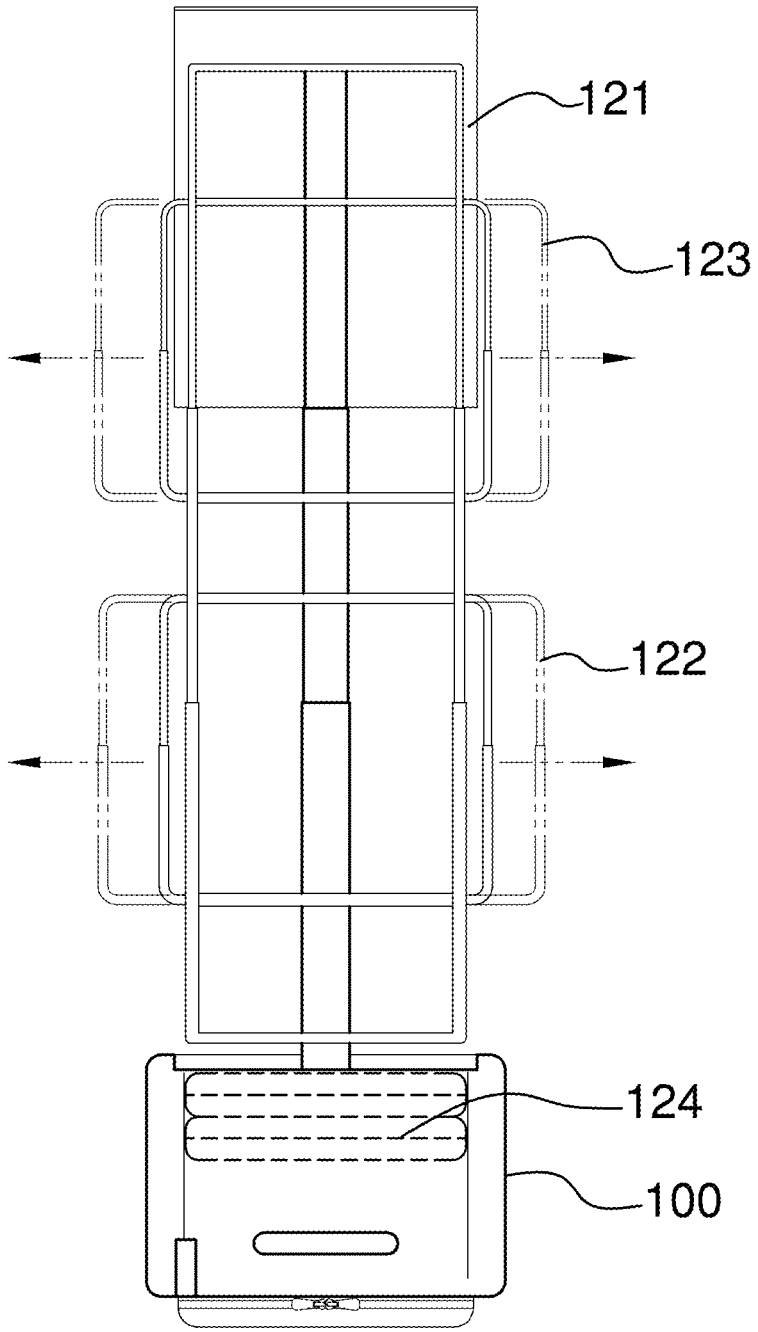
FIG. 6 is a top view of an embodiment of the disclosure.
Figure 7:
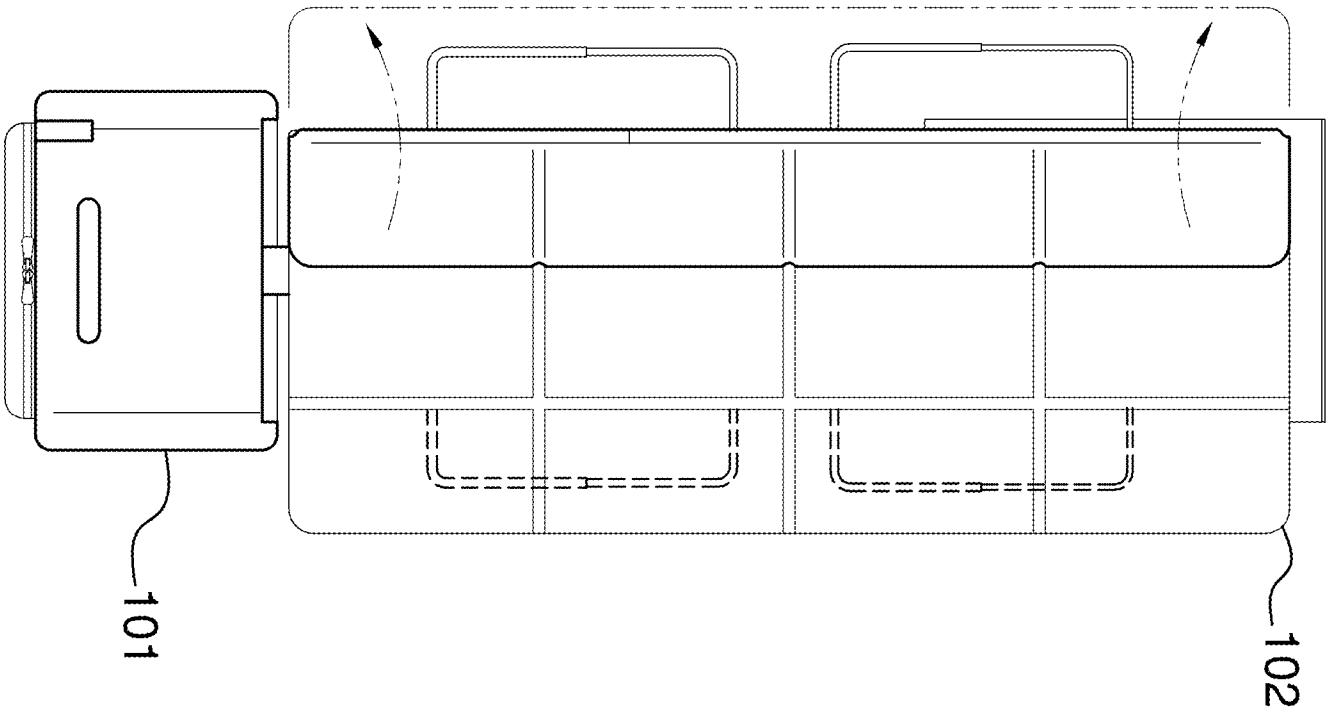
FIG. 7 is a top view of an embodiment of the disclosure.
Figure 8:
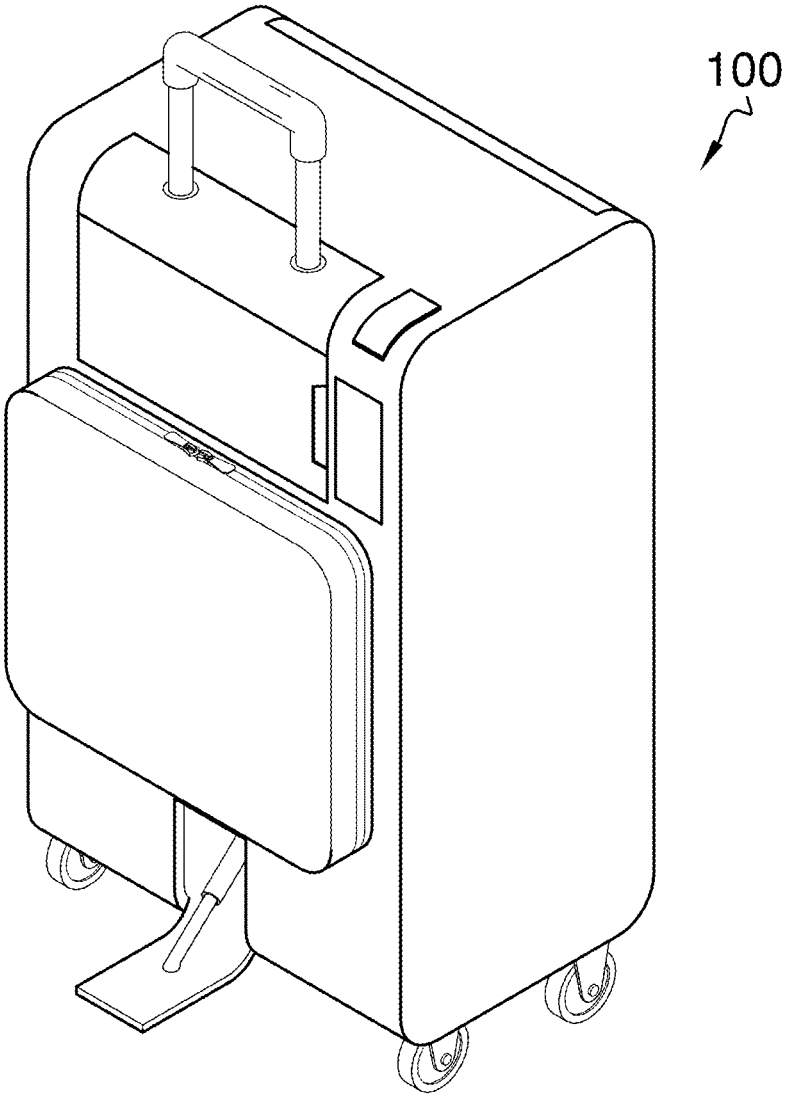
FIG. 8 is a perspective view of an alternate embodiment of the disclosure.
Figure 9:
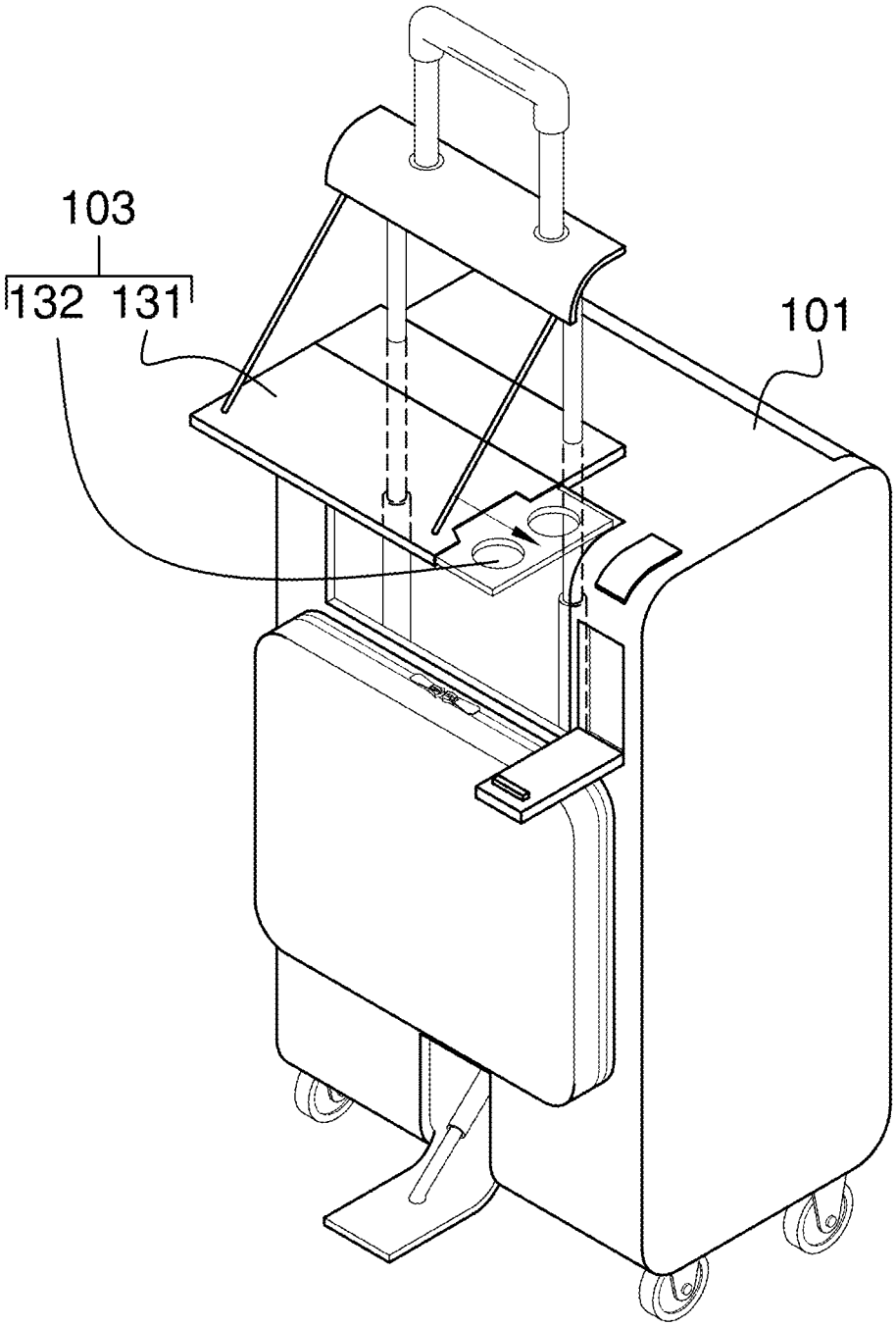
FIG. 9 is a perspective view of an alternate embodiment of the disclosure.

Detailed reference will now be made to one or more potential embodiments of the disclosure, which are illustrated in FIGS. 1 through 9.

The luggage with fold out platform surface 100 (hereinafter invention) is a luggage item. The invention 100 comprises a frame structure 101, a platform structure 102, and a nightstand structure 103. The platform structure 102 and the nightstand structure 103 attach to the frame structure 101. The platform structure 102 is a collapsible structure. The platform structure 102 deploys to form an elevated and horizontally oriented platform that is used as a bed. The nightstand structure 103 deploys to form an elevated horizontally oriented working surface.

The frame structure 101 is a roughly prism shaped structure. The frame structure 101 is a hollow structure. The frame structure 101 is a load bearing structure. The frame structure 101 forms a protected space used to store the domestic articles of a traveling individual. The frame structure 101 is a rolling structure. The frame structure 101 comprises an anterior face structure 111, a posterior face structure 112, a plurality of lateral face structures 113, and a plurality of accessory structures 114.

The anterior face structure 111 forms a congruent end of the prism structure of the frame structure 101. The anterior face structure 111 is formed with an enclosable port that provides access into the protected space formed by the frame structure 101.

The posterior face structure 112 forms a congruent end of the prism structure of the frame structure 101. The posterior face structure 112 forms the congruent end of the frame structure 101 that is distal from the anterior face structure 111. The platform structure 102 deploys from the posterior face structure 112. The platform structure 102 retracts to the posterior face structure 112.

The plurality of lateral face structures 113 form the lateral faces of the prism structure of the frame structure 101. The plurality of lateral face structures 113 further comprises a superior lateral face structure 151 and an inferior lateral face structure 152.

The inferior lateral face structure 152 forms a lateral face of the prism structure of the frame structure 101. The inferior lateral face structure 152 forms the lateral face of the frame structure 101 that is proximal to the supporting surface when the frame structure 101 rolls over the supporting surface. The superior lateral face structure 151 forms a lateral face of the prism structure of the frame structure 101. The superior lateral face structure 151 is the lateral face of the frame structure 101 that is distal from the inferior lateral face structure 152.

The plurality of accessory structures 114 comprises a set of mechanical structures that are used to move, store, and stabilize the frame structure 101. The plurality of accessory structures 114 further comprises an extensible handle structure 161, an extensible hook structure 162, a stabilizing footing structure 163, and a plurality of caster structures 164.

The extensible handle structure 161 is a grip. The extensible handle structure 161 is used to hold and manipulate the invention 100 as the invention 100 rolls over the supporting surface. The extensible handle structure 161 mounts in the superior lateral face structure 151 of the frame structure 101. The extensible handle structure 161 is an extensible structure. The extensible handle structure 161 deploys by extending out of the superior lateral face structure 151.

The extensible hook structure 162 is a hook. The extensible hook structure 162 is used to suspend the invention 100 above a supporting surface. The extensible hook structure 162 mounts in the superior lateral face structure 151 of the frame structure 101. The extensible hook structure 162 is an extensible structure. The extensible hook structure 162 deploys by extending out of the superior lateral face structure 151.

The plurality of caster structures 164 form a rolling structure. The plurality of caster structures 164 mount on the exterior surface of the inferior lateral face structure 152 of the frame structure 101. The plurality of caster structures 164 form a load bearing structure. The plurality of caster structures 164 form the final link in the load path that transfers the load of the invention 100 to the supporting surface. The plurality of caster structures 164 allow the invention 100 to roll over the supporting surface.

The stabilizing footing structure 163 is a stabilizing structure. The stabilizing footing structure 163 mounts at the brink of the posterior face structure 112. The stabilizing footing structure 163 forms a brace that prevents the center of mass of the invention 100 from shifting when the invention 100 is subjected to an external force.

The platform structure 102 attaches to the frame structure 101. The platform structure 102 forms an elevated horizontally oriented surface. The platform structure 102 forms a bed. The platform structure 102 is a collapsible structure. The platform structure 102 attaches to the frame structure 101 such that platform structure 102 deploys from the frame structure 101 to form the bed. The platform structure 102 retracts back into the frame structure 101 for storage. The platform structure 102 comprises a platform surface 121, a proximal stanchion structure 122, a distal stanchion structure 123, and a mattress structure 124.

The platform surface 121 is a disk shaped structure. The platform surface 121 is a load bearing structure. The platform surface 121 is a collapsible structure. The platform surface 121 attaches to the posterior face structure 112 of the frame structure 101. The platform surface 121 is a rotating structure. The platform surface 121 attaches to the posterior face structure 112 such that the platform surface 121 rotates relative to the posterior face structure 112. The platform surface 121 rotates between a closed position and an open position. The platform surface 121 deploys from the closed position into the open position. In the open position, the platform surface 121 forms the elevated horizontally oriented surface of the platform structure 102.

The proximal stanchion structure 122 is a load bearing structure. The proximal stanchion structure 122 attaches to the platform surface 121 such that the proximal stanchion structure 122 rotates relative to the platform surface 121. The proximal stanchion structure 122 deploys into a vertically oriented structure. The proximal stanchion structure 122 forms a portion of the load path that transfers the load of the platform surface 121 and the mattress structure 124 to the supporting surface.

The distal stanchion structure 123 is a load bearing structure. The distal stanchion structure 123 attaches to the platform surface 121 such that the proximal stanchion structure 122 rotates relative to the platform surface 121. The distal stanchion structure 123 deploys into a vertically oriented structure. The distal stanchion structure 123 forms a portion of the load path that transfers the load of the platform surface 121 and the mattress structure 124 to the supporting surface.

The frame structure 101 forms a portion of the load path that transfers the load of the platform surface 121 and the mattress structure 124 to the supporting surface. The distal stanchion structure 123 attaches to the platform surface 121 such that the proximal stanchion structure 122 is between the distal stanchion structure 123 and the frame structure 101.

The mattress structure 124 is a mattress. The mattress structure 124 is geometrically similar to the platform surface 121. The mattress structure 124 rests on the superior congruent end of the platform surface 121 when the platform structure 102 is deployed. The mattress structure 124 is a collapsible structure. The mattress structure 124 folds onto itself when the platform structure 102 collapses into the closed position. The mattress structure 124 unfolds as the platform structure 102 deploys into an open position.

The nightstand structure 103 is a platform. The nightstand structure 103 permanently attaches to the frame structure 101. The nightstand structure 103 is deployed from the frame structure 101 for use. The nightstand structure 103 inserts into the frame structure 101 for storage. The nightstand structure 103 is a load bearing structure. The nightstand structure 103 forms an elevated horizontally oriented surface. The nightstand structure 103 forms an elevated workspace that elevates objects above the supporting surface. The nightstand structure 103 comprises a working surface 131 and a one or more cup holders 132.

The working surface 131 is a disk shaped structure. The working surface 131 attaches to the superior lateral face structure 151 of the frame structure 101. The working surface 131 inserts into the superior lateral face structure 151 for storage. The working surface 131 is withdrawn from the superior lateral face structure 151 to form a horizontally oriented working surface. The working surface 131 forms a load bearing structure that elevates one or more objects above the supporting surface.

Each cup holder selected from the one or more cup holders 132 is a negative space that is formed through the congruent ends of the disk structure of the working surface 131. Each selected cup holder is intended to hold a beverage in a fixed position while the nightstand structure 103 is in use.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anterior: As used in this disclosure, anterior is a term that is used to refer to the front side or direction of a structure. When comparing two objects, the anterior object is the object that is closer to the front of the structure.

Barrier: As used in this disclosure, a barrier is a physical obstacle that forms a boundary between a first space and a second space. The barrier prevents the passage of an object between the first space and the second space.

Bed: As used in this disclosure, a bed refers to a structure, typically a furniture item, used for sleeping or resting. When the structure is a furniture item, the bed comprises a frame and a mattress. The frame is a pedestal that elevates the mattress. A bed often further comprises one or more box frames. The one or more box frames are mechanical structures that form secondary pedestals that elevate the mattress above the frame. A bed often further comprises a headboard. The headboard is a decorative element that forms a protective barrier between the bed and a wall the bed is placed next to.

Bridge: As used in this disclosure, a bridge refers to a load bearing structure that attaches a first object and to a second object such that a load bearing path is formed between the first object and the second object. The verb "to bridge" means to establish a connection (or remove a disconnection) between a first object and a second object.

Brink: As used in this disclosure, a brink refers to the edge or line formed by the intersection of a first plane or surface and a second plane or surface wherein a cant exists between the first plane or surface and the second plane or surface.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Collapsible: As used in this disclosure, the terms collapsible refers to an object that is configured such that the volume of the object is adjustable. By volume is meant the volume of the perimetrical boundary that contains the object. The verbs collapse and retract mean that the volume of the perimetrical boundary of the object changes from a larger volume to a smaller volume. The verbs expand and deploy mean that the volume of the perimetrical boundary of the object changes from a smaller volume to a larger volume.

Closed Position: As used in this disclosure, a closed position refers to a movable structure that is in an orientation that minimizes the perimetrical boundary presented by the movable structure. The closed position is often referred to as an object being "closed."

Composite Prism: As used in this disclosure, a composite prism refers to a structure that is formed from a plurality of structures selected from the group consisting of a prism structure, a pyramid structure, and a spherical structure. The plurality of selected structures may or may not be truncated or bifurcated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Container: As used in this disclosure, a container is a structure that forms a protected space (or protection space) used to store and transport an object. The term containment structure is a synonym for container.

Correspond: As used in this disclosure, the term correspond is used as a comparison between two or more objects wherein one or more properties shared by the two or more objects match, agree, or align within acceptable manufacturing tolerances.

Cushion: As used in this disclosure a cushion is a pad or pillow formed from soft material that is used for resting, sleeping, or reclining. A cushion can also be used to prevent injury or damage.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Domestic Article: As used in this disclosure, a domestic article is an item or object: 1) that is commonly found within 9 a household; or, 2) that is commonly carried or worn by a person. Examples of domestic articles include, but are not limited to, furniture, kitchen appliances, clothing, keys and key fobs, personal data devices, glasses, remote controls, or personal storage items such as purses, briefcases, wallets, or cases.

Elevation: As used in this disclosure, elevation refers to the span of the distance in the superior direction between a specified horizontal surface and a reference horizontal surface. Unless the context of the disclosure suggests otherwise, the specified horizontal surface is the supporting surface the potential embodiment of the disclosure rests on. The infinitive form of elevation is to elevate.

Environment: As used in this disclosure, an environment refers to the physical conditions surrounding an object. The term environment is often limited to the physical conditions that the object interacts with.

Extensible: As used in this disclosure, extensible is an adjective that describes an object made of sections that fit or together such that the object can be made longer or shorter by adjusting the relative positions of the sections.

Extension Structure: As used in this disclosure, an extension structure is an inert physical structure that is used to extend or bridge the reach between any two objects.

Exterior: As used in this disclosure, the exterior is used as a relational term that implies that an object is not contained within the boundary of a structure or a space.

Exterior: As used in this disclosure, the exterior is used as a relational term that implies that an object is not contained within the boundary of a structure or a space.

Fold: As used in this disclosure, to fold means to bend an object back upon itself.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. By the term essentially geometrically similar is meant that the primary shapes of two objects are geometrically similar except that there are functional items (such as fastening devices) associated with the primary shape may not maintain the ratio for geometric similarity. By the term roughly geometrically similar is meant that the form factors between the primary shape of the two objects can vary by a factor of up to 10% when the two objects are normalized to be roughly geometrically identical.

Grip: As used in this disclosure, a grip is an accommodation formed on or within an object that allows the object to be grasped or manipulated by a hand.

Ground: As used in this disclosure, the ground is a solid supporting surface formed by the Earth. The term level ground means that the supporting surface formed by the ground is roughly perpendicular to the force of gravity. The term underground refers to an object being underneath the superior surface of the ground.

Handle: As used in this disclosure, a handle is an object by which a tool, object, or door is held or manipulated with the hand.

Hinge: As used in this disclosure, a hinge is a device that permits the turning, rotating, or pivoting of a first object relative to a second object. A hinge designed to be fixed into a set position after rotation is called a locking hinge. A spring loaded hinge is a hinge formed as an elastic structure. The elastic structure of the spring loaded hinge is deformed under a rotating force such that the elastic structure returns the spring loaded hinge back to its relaxed shape after the rotating force is removed from the spring loaded hinge.

Hook: As used in this disclosure, a hook is an object that is curved or bent at an angle such that items can be hung on or caught by the object.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Lateral: As used in this disclosure, the term lateral refers to the movement of an object that is perpendicular to the primary sense of direction of an object and parallel to the horizontal plane (or perpendicular to the vertical plane). Lateral movement is always perpendicular to the anterior posterior axis. Lateral movement is often called sideways movement.

Left and Right: As used in this disclosure, the terms left and right are directional references associated with an object. The object is further defined with an anterior surface and a posterior surface. The terms left and right are standardized naming conventions for the lateral directions of the object. The terms left and right use the human body for the initial definition of the orientation. Specifically, when a human body is viewed from posterior side towards the anterior side, the left side of the human body is the lateral side of the human body that contains the heart. The right side of the human body is the lateral side of the body that contains the bulk of the liver. The left and right sides of the human body remain unchanged by changes to the direction from which the human body is viewed. The left side of any object is the same side as the left side of the human body when the object is viewed from posterior side towards the anterior side. The right side of any object is the same side as the right side of the human body when the object is viewed from posterior side towards the anterior side. The left and right sides of the object remain unchanged by changes to the direction from which the object is viewed.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Luggage: As used in this disclosure, luggage is a trunk, bag, purse, parcel, suitcase, or backpack in which domestic articles are contained during travel.

Mattress: As used in this disclosure, a mattress is a disk-shaped structure that forms a cushion used by a patient when lying flat. The superior congruent end of the disk structure of the mattress forms a horizontally oriented surface.

Negative Space: As used in this disclosure, negative space is a method of defining an object through the use of open or empty space as the definition of the object itself, or, through the use of open or empty space to describe the boundaries of an object.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction. In a one to one correspondence, the first element of the first set is said to be associated to the second element of the second set to which the first element corresponds.

Open Position: As used in this disclosure, an open position refers to a movable structure that is in an orientation that presents a perimetrical boundary of the movable structure that is greater than the closed position. The open position is often referred to as an object being "open."

Orientation: As used in this disclosure, orientation refers to the positioning of a first object relative to: 1) a second object; or, 2) a fixed position, location, or direction.

Pan: As used in this disclosure, a pan is a hollow containment structure. The pan has a shape selected from the group consisting of: a) a prism; and, b) a truncated pyramid. The pan has a single open face. The open face of the pan is often, but not always, the superior face of the pan. The open face is a surface selected from the group consisting of: a) a congruent end of the prism structure that forms the pan; b) a lateral face of the prism structure that forms the pan, c) the base face of the truncated pyramid structure; and, d) the truncated face of the truncated pyramid structure. A semi-enclosed pan refers to a pan wherein the closed end of prism structure of the pan and/or a portion of the lateral face of the pan is also open.

Pedestal: As used in this disclosure, a pedestal is an intermediary load bearing structure that forms a load path between two objects or structures.

Perimeter: As used in this disclosure, a perimeter is one or more curved or straight lines that bounds an enclosed area on a plane or surface. The perimeter of a circle is commonly referred to as a circumference.

Perimetrical Boundary: As used in this disclosure, a perimetrical boundary is a hypothetical rectangular block that contains an object. Specifically, the rectangular block selected to be the perimetrical boundary is the rectangular block with the minimum volume that fully contains the object. In a two-dimensional structure, the perimetrical boundary is the rectangle with the minimum surface area.

Pivot: As used in this disclosure, a pivot is a rod or shaft around which an object rotates or swings.

Platform: As used in this disclosure, a platform is an elevated horizontal surface that forms a load path to support objects placed on the superior surface of the platform.

Posterior: As used in this disclosure, posterior is a term that is used to refer to the side of an object that is distal or in the opposite direction of the anterior side. When comparing two items, the posterior item is the item that is distal from the anterior of the object.

Primary Sense of Direction: As used in this disclosure, the primary sense of direction of an object refers to a vector that: 1) passes through the center of the object; and, 2) is parallel to the direction of travel when the anterior surface(s) of the object are leading the object into the direction of travel. This definition intends to align with what people would normally call the forward direction of an object.

Primary Shape: As used in this disclosure, the primary shape refers to a description of the rough overall geometric shape of an object that is assembled from multiple components or surfaces. The term essential primary shape is used to indicate the exclusion of functional items that are attached to the structure of the primary shape.

Primary Structure: As used in this disclosure, a primary structure refers to the component of an object that the other components attach to. The primary structure is also called the base structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protected Space: As used in this disclosure, a protected space is a negative space within which an object is stored. The protected space is enclosed by a barrier structure that: a) prevents damage to the object contained within the protected space; b) maintains conditions that are appropriate for the object; c) protects the object within the protected space from potential dangers that are outside of the protected space; or, d) maintains the privacy of the object within the protected space.

Reach: As used in this disclosure, reach refers to a span of distance between any two objects.

Rigid Structure: As used in this disclosure, a rigid structure is a solid structure formed from an inelastic material that resists changes in shape. A rigid structure will permanently deform as it fails under a force. See bimodal flexible structure.

Rotation: As used in this disclosure, rotation refers to the cyclic movement of an object around a fixed point or fixed axis. The verb of rotation is to rotate.

Roughly: As used in this disclosure, roughly refers to a comparison between two objects. Roughly means that the difference between one or more parameters of the two compared objects are not significantly different.

Stanchion: As used in this disclosure, a stanchion refers to a vertically oriented prism-shaped pole, post, or support.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 9 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A luggage with fold out platform surface comprising
a frame structure and a platform structure;
wherein the platform structure attaches to the frame structure;
wherein the frame structure is a load bearing structure;
wherein the platform structure forms a bed;
wherein the frame structure forms a protected space;
wherein a platform surface of the platform structure attaches to a posterior face structure of the frame structure;
wherein the platform surface rotates between a closed position and an open position;
wherein a mattress structure of the platform structure folds onto itself when the platform structure collapses into the closed position;
wherein the mattress structure unfolds as the platform structure deploys into an open position;
wherein a nightstand structure permanently attaches to the frame structure;
wherein the nightstand structure is deployed from the frame structure for use.

2. The luggage with fold out platform surface according to claim 1
wherein the frame structure is a prism shaped structure;
wherein the frame structure is a hollow structure;
wherein the frame structure forms the protected space used to store a plurality of domestic articles;
wherein the frame structure is a rolling structure.

3. The luggage with fold out platform surface according to claim 2
wherein the platform structure attaches to the frame structure;
wherein the platform structure forms an elevated horizontally oriented surface;
wherein the platform structure is a collapsible structure.

4. The luggage with fold out platform surface according to claim 3
wherein the frame structure comprises an anterior face structure, the posterior face structure, a plurality of lateral face structures, and a plurality of accessory structures;
wherein the anterior face structure forms a congruent end of the prism structure of the frame structure;
wherein the anterior face structure is formed with an enclosable port that provides access into the protected space formed by the frame structure;
wherein the posterior face structure forms a congruent end of the prism structure of the frame structure;
wherein the posterior face structure forms the congruent end of the frame structure that is distal from the anterior face structure;
wherein the platform structure deploys from the posterior face structure;
wherein the platform structure retracts to the posterior face structure;
wherein the plurality of lateral face structures form the lateral faces of the prism structure of the frame structure;
wherein the plurality of accessory structures comprises a set of mechanical structures that are used to move, store, and stabilize the frame structure.

5. The luggage with fold out platform surface according to claim 4 wherein the plurality of lateral face structures further comprises a superior lateral face structure and an inferior lateral face structure;

wherein the inferior lateral face structure forms a lateral face of the prism structure of the frame structure;

wherein the inferior lateral face structure forms the lateral face of the frame structure that is proximal to the supporting surface when the frame structure rolls over the supporting surface;

wherein the superior lateral face structure forms a lateral face of the prism structure of the frame structure;

wherein the superior lateral face structure is the lateral face of the frame structure that is distal from the inferior lateral face structure.

6. The luggage with fold out platform surface according to claim 5 wherein the plurality of accessory structures further comprises an extensible handle structure, an extensible hook structure, a stabilizing footing structure, and a plurality of caster structures;

wherein the extensible handle structure is a grip;

wherein the extensible handle structure is used to hold and manipulate the luggage with fold out platform surface as the luggage with fold out platform surface rolls over the supporting surface;

wherein the extensible handle structure mounts in the superior lateral face structure of the frame structure;

wherein the extensible handle structure is an extensible structure;

wherein the extensible handle structure deploys by extending out of the superior lateral face structure;

wherein the extensible hook structure is a hook;

wherein the extensible hook structure is used to suspend the luggage with fold out platform surface above a supporting surface;

wherein the extensible hook structure mounts in the superior lateral face structure of the frame structure;

wherein the extensible hook structure is an extensible structure;

wherein the extensible hook structure deploys by extending out of the superior lateral face structure;

wherein the plurality of caster structures form a rolling structure;

wherein the plurality of caster structures mount on the exterior surface of the inferior lateral face structure of the frame structure;

wherein the plurality of caster structures form a load bearing structure;

wherein the plurality of caster structures form the final link in the load path that transfers the load of the luggage with fold out platform surface to the supporting surface;

wherein the plurality of caster structures allow the luggage with fold out platform surface to roll over the supporting surface;

wherein the stabilizing footing structure is a stabilizing structure;

wherein the stabilizing footing structure mounts at the brink of the posterior face structure;

wherein the stabilizing footing structure forms a brace that prevents the center of mass of the luggage with fold out platform surface from shifting when the luggage with fold out platform surface is subjected to an external force.

7. The luggage with fold out platform surface according to claim 6 wherein the platform structure comprises the platform surface, a proximal stanchion structure, a distal stanchion structure, and the mattress structure;

wherein the platform surface attaches to the frame structure;

wherein the proximal stanchion structure and the distal stanchion structure attach to the platform structure;

wherein the mattress structure rests on the platform structure.

8. The luggage with fold out platform surface according to claim 7 wherein the platform surface is a disk shaped structure;

wherein the platform surface is a load bearing structure;

wherein the platform surface is a collapsible structure;

wherein the platform surface is a rotating structure;

wherein the platform surface attaches to the posterior face structure such that the platform surface rotates relative to the posterior face structure;

wherein the platform surface deploys from the closed position into the open position;

wherein in the open position, the platform surface forms the elevated horizontally oriented surface of the platform structure.

9. The luggage with fold out platform surface according to claim 8 wherein the proximal stanchion structure is a load bearing structure;

wherein the proximal stanchion structure attaches to the platform surface such that the proximal stanchion structure rotates relative to the platform surface;

wherein the proximal stanchion structure deploys into a vertically oriented structure;

wherein the proximal stanchion structure forms a portion of the load path that transfers the load of the platform surface and the mattress structure to the supporting surface;

wherein the distal stanchion structure is a load bearing structure;

wherein the distal stanchion structure attaches to the platform surface such that the proximal stanchion structure rotates relative to the platform surface;

wherein the distal stanchion structure deploys into a vertically oriented structure;

wherein the distal stanchion structure forms a portion of the load path that transfers the load of the platform surface and the mattress structure to the supporting surface;

wherein the frame structure forms a portion of the load path that transfers the load of the platform surface and the mattress structure to the supporting surface;

wherein the distal stanchion structure attaches to the platform surface such that the proximal stanchion structure is between the distal stanchion structure and the frame structure.

10. The luggage with fold out platform surface according to claim 9 wherein the mattress structure is a mattress;

wherein the mattress structure is geometrically similar to the platform surface;

wherein the mattress structure rests on the superior congruent end of the platform surface when the platform structure is deployed;

wherein the mattress structure is a collapsible structure.

11. The luggage with fold out platform surface according to claim 10 wherein the platform structure further comprises the nightstand structure;

wherein the nightstand structure is a platform;

wherein the nightstand structure inserts into the frame structure for storage;

wherein the nightstand structure is a load bearing structure;

wherein the nightstand structure forms an elevated horizontally oriented surface.

12. The luggage with fold out platform surface according to claim 11 wherein the nightstand structure comprises a working surface and a one or more cup holders;

wherein the working surface is a disk shaped structure;

wherein the working surface attaches to the superior lateral face structure of the frame structure;

wherein the working surface inserts into the superior lateral face structure for storage;

wherein the working surface is withdrawn from the superior lateral face structure to form a horizontally oriented working surface;

wherein the working surface forms a load bearing structure that elevates one or more objects above the supporting surface;

wherein each cup holder selected from the one or more cup holders is a negative space that is formed through the congruent ends of the disk structure of the working surface.

* * * * *